United States Patent [19]

Kaupin et al.

[11] 4,257,127

[45] Mar. 24, 1981

[54] INFANT GARMENT, BLANK THEREFOR, AND METHOD OF MAKING THE GARMENT

[75] Inventors: William B. Kaupin, Westwood; Stephen P. Szczesuil, Framingham, both of Mass.

[73] Assignee: The William Carter Company, Needham Heights, Mass.

[21] Appl. No.: 19,349

[22] Filed: Mar. 12, 1979

[51] Int. Cl.[3] ..... A41D 11/00

[52] U.S. Cl. ..... 2/75; 2/80

[58] Field of Search ..... 2/80, 83, 75, 74, 73

[56] References Cited

U.S. PATENT DOCUMENTS

| | | | |
|---|---|---|---|
| 1,256,736 | 2/1918 | Sheehy | 2/80 |
| 1,292,703 | 1/1919 | Carter | 2/80 |
| 1,797,604 | 3/1931 | Burgdorfer | 2/75 |
| 2,437,988 | 3/1948 | Artzt | 2/80 |
| 2,671,220 | 3/1954 | Giessmann | 2/80 |
| 3,435,461 | 4/1969 | Artzt | 2/83 |
| 3,568,213 | 3/1971 | Mason | 2/80 |

FOREIGN PATENT DOCUMENTS

| | | | |
|---|---|---|---|
| 1460028 | 2/1969 | Fed. Rep. of Germany | 2/75 |

*Primary Examiner*—H. Hampton Hunter

[57] ABSTRACT

A garment for infants, and a method and blank for making it. The garment provides a neck opening and a placket extending longitudinally from the neck opening. At least a major portion of the garment comprises a single fabric piece, comprising a lower body portion and a shoulder/arm portion, which are integral with one another through the back of the garment. The shoulder/arm portion is integral and seamless over each shoulder; right and left under-sleeve seams partially close the shoulder/arm portion to form right and left sleeve tubes. The lower body portion is integral and seamless between the margins of the placket around the garment. The garment has left and right median seams each joining the shoulder/arm portion and the lower body portion between an under-sleeve seam and the adjacent placket margin.

15 Claims, 7 Drawing Figures

INFANT GARMENT, BLANK THEREFOR, AND METHOD OF MAKING THE GARMENT

This invention relates to a garment for children, of the type having leg and foot coverings integral with the body portion and having a single releasably securable front opening extending from the neck to the crotch or beyond for easy dressing of the child, and to a method of making such a garment.

A garment of this description, often referred to as "all in one," is an extremely useful and convenient item, particularly for small infants, in being easily removable, simple to launder, and warm and comfortable for the infant. Numerous designs for garments of this general type are known. In mass production of such garments, however, it is found that various problems occur.

Such garments are produced by a method which involves cutting large numbers of them from a fabric sheet or tube. Many of the known designs of this type of garment entail wastage of as much as 20% of the fabric sheet. It would therefore be desirable to provide a design for such a garment that can be cut in large quantities with reduced fabric wastage.

Further, in the assembly of such garments, the number of seams to be stitched is directly related to the time required to assemble the garment, which affects the cost of production. Moreover, it has been found in practice that defective stitching of the seams is the most frequent cause for rejection of a garment as unsalable. Also, when the garment fails in wear, it is generally at a seam. Consequently, it is desirable in the design of such garments to reduce the number of pieces to be assembled and the total length of seams to be stitched as far as possible.

In addition, when garments in mass production are assembled from a number of separately cut pieces, two pieces to be joined (for example, a sleeve and a garment body portion) may have been cut from different bolts of cloth, with the result that the colors of the two pieces do not match. This is particularly true of printed materials, and is a frequent cause for rejection of garments as not being of first quality. The likelihood of this defect is reduced when the garment is assembled from fewer pieces.

Previous efforts to design an infant's garment of this type with minimal seaming have generally resulted in a garment which conforms poorly to the infant's body, and in particular may have excess fabric and bunching under the infant's arms. It is desirable to provide such a garment that fits the infant comfortably without bunching.

It is therefore an object of this invention to provide a blank for an infant's garment which can be cut in multiples from a sheet of fabric with less wastage of cloth than has been entailed with known designs.

It is a further object of this invention to provide an infant's garment that includes fewer and shorter seams than are required in garments of known design, and that is therefore less expensive to manufacture and more reliable in use than garments of known design.

It is an additional object to provide such a garment that comforms well to the shape of the infant, particularly in reducing excess fabric and bunching in the region under the infant's arms.

According to the invention, a blank for at least a major portion of an infant's garment is generally symmetrical about a longitudinal midline defining right and left blank parts. Each blank part has a lateral free edge generally parallel to the midline, and a cut extending inwardly from the lateral free edge toward the midline to an interior point approximately one-half the perpendicular distance from the lateral free edge to the midline. The right and left cuts together with the line connecting the right and left interior points divides the blank part into a lower body portion and a shoulder/-arm portion. Each cut defines opposed edges comprising a median seam edge bordering the lower body portion and an under-sleeve seam edge bordering the shoulder/arm portion.

The blank shoulder/arm portion provides a garment neck opening lying on the midline. Each blank part shoulder/arm portion has an upper free edge lying between the line of the lateral free edge and the midline. Each upper free edge comprises a proximal portion adjacent the midline and a distal portion remote therefrom. The upper free edge distal portion and the under-sleeve seam edge of a blank part are opposable by folding of the shoulder/arm portion along a shoulder line to define an under-sleeve seam, and the upper free edge proximal portion and median seam edge of the blank part are opposable by folding to define a median seam.

A garment is formed from the blank by folding each shoulder/arm portion downwardly toward the middle of the garment, and folding each lower body portion toward the midline. The opposed upper free edge distal portions and under-sleeve seam edges are joined, and the opposed upper free edge proximal portions and median seam edges are joined, to define under-sleeve seams and median seams.

The infant's garment of the invention is generally symmetrical about a longitudinal midline defining right and left parts thereof, and provides a neck opening lying on the midline and placket edges defining a garment placket extending longitudinally from the neck opening. At least a major portion of the garment comprises a single fabric piece, comprising a lower body portion and a shoulder/arm portion. The portions are integral with one another through the back of the garment. The shoulder/arm portion is integral over each shoulder of the garment, the garment having right and left under-sleeve seams partially closing the shoulder/arm portion to form right and left sleeve tubes. The lower body portion is integral between the placket margins around the garment. The garment has right and left median seams each joining the shoulder/arm portion and the lower body portion between an under-sleeve seam and the adjacent placket margin.

The infant's garment of the invention may be formed entirely from a single blank without additional pieces, or alternatively a major portion of the garment may be formed from an integral blank, and additional small pieces (for example, a foot piece, crotch, cuff, or neck band, or several of these) may be added thereto. The additional pieces are optional and their design is known.

Other objects, features and advantages will appear from the following description of a preferred embodiment of the invention, together with the drawing, in which.

Figure 2:
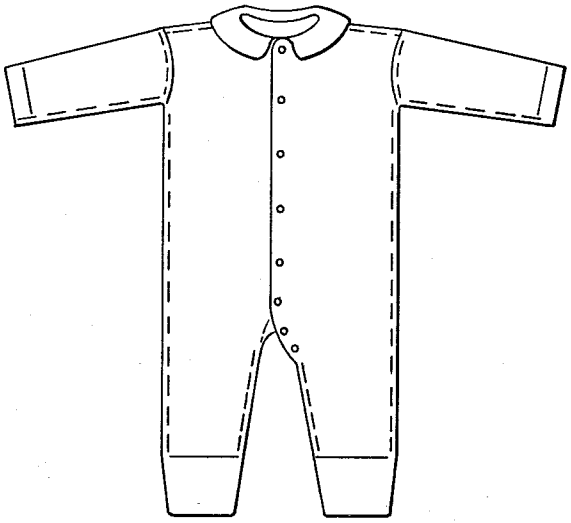

Infants' all-in-one garments as hitherto designed and made have been of two general kinds. The first kind, as seen in FIG. 2, is assembled somewhat like a garment (for example a shirt) for adults, in having separately cut set-in sleeves, seams across the tops of the shoulders, seams extending along the lower edge of the sleeve from wrist to body, and along the entire side of the body and leg, as well as the inner leg. (Seams are indicated by dashes along the seam line.) Such a garment provides good fit and conformability to the infant's shape, but is expensive to manufacture and provides extensive seaming that may fail in use.

Figure 3:
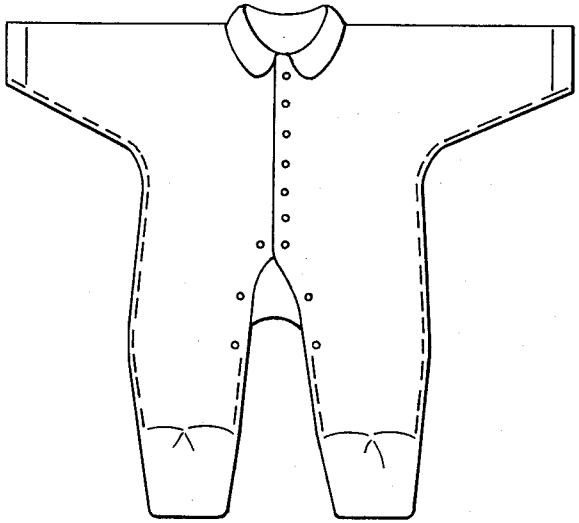
FIGS. 2 and 3 show prior art garments.

In the second kind, of which an example is seen in FIG. 3 (from U.S. Pat. No. 3,435,461), the major body portions are all in one piece, so that by folding, edges are brought together for seaming. The one-piece cut with folds reduces the number of seams required to construct the garment.

Garments of this second type tend to have problems of fit, as they are essentially flat and do not conform accurately to the convex three-dimensional form of the infant's body having many different degrees of curvature.

From a consideration of these examples of the prior art, it would appear that the reduction of seams by designing the garment to be cut in one major piece and partially folded tends to degrade the conformability and fit of the garment, so that it would be expected that the seaming in such a garment could not in practice be further reduced without compromising the fit so greatly as to produce an unsatisfactory product.

However, it has been found that the novel design of the present invention makes possible a garment having even less seaming than is required in those of the partially folded prior art, while providing better conformability and fit than such prior art has achieved.

In addition, it has been found that in mass production, garments according to the present invention can be cut with a greatly reduced wastage of fabric as compared with wastage of prior art designs.

Figure 1:
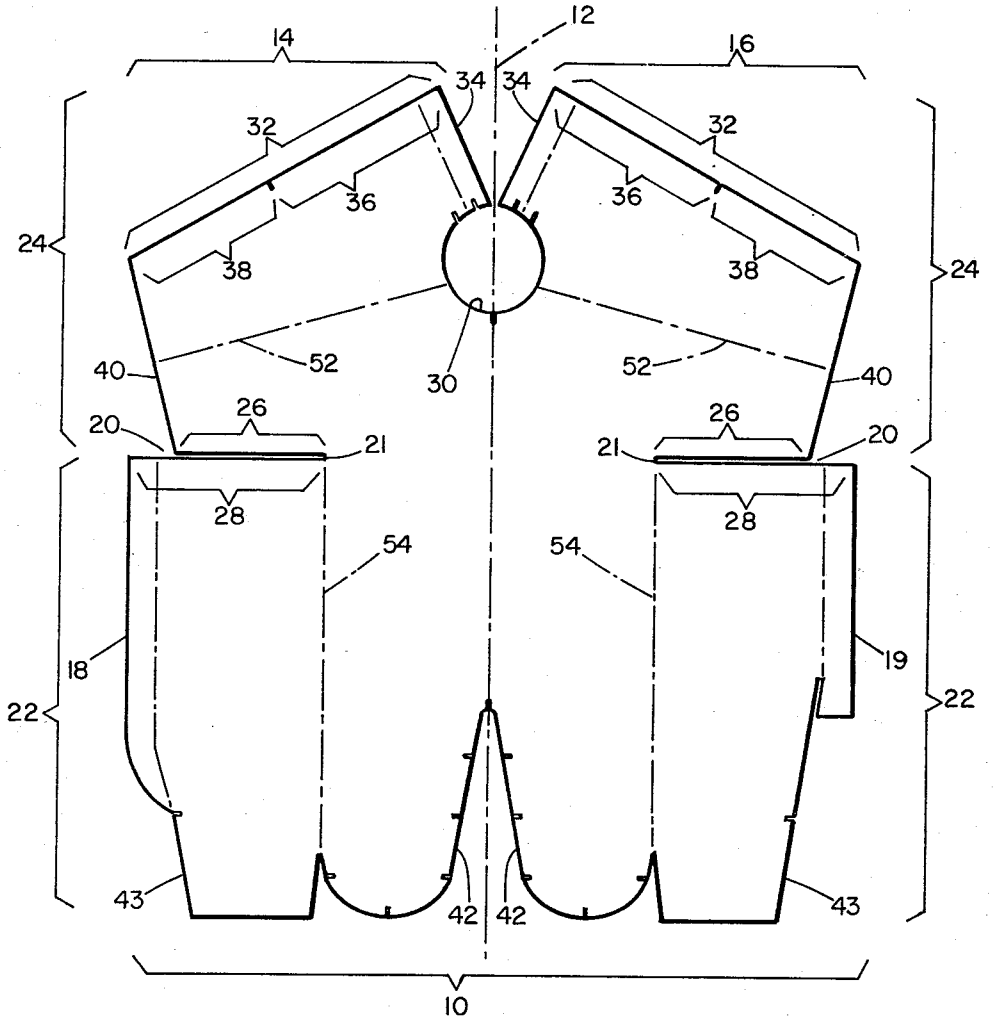
FIG. 1 shows a blank for at least a major portion of a garment according to the invention.

Referring now to the drawing, and particularly to FIG. 1, a blank 10 is shown for the major portion of an infant's garment according to a first embodiment of the invention. The blank is generally symmetric about a longitudinal midline 12 which defines right and left blank parts 14 and 16. Right blank part 14 has a lateral free edge 18, and left blank part 16 has a lateral free edge 19, both generally parallel to midline 12. Each blank part has a cut 20 extending inwardly from its lateral free edge generally perpendicular to midline 12 to an interior point 21 at approximately one-half the perpendicular distance from the lateral free edge 18 or 19 to midline 12.

The line of cut 20 divides each of the blank parts into a lower body portion 22 and an upper shoulder/arm portion 24. Each cut 20 defines opposed edges 26 and 28. Edge 26, bordering shoulder/arm portion 24, is an under-sleeve seam edge; edge 28, bordering lower body portion 22, is a median seam edge.

The right and left shoulder/arm portions 24 together provide a garment neck opening 30 lying on axis 12. Each shoulder/arm portion has a generally straight upper free edge 32 inclined upwardly from the line of lateral free edge 18 toward midline 12, and a placket upper edge 34 extending between upper free edge 32 and neck opening 30, the placket upper edge being generally perpendicular to the upper free edge.

Each upper free edge 32 comprises a proximal portion 36 adjacent placket upper edge 34, and a distal portion 38 remote therefrom. Portions 36 and 38 are colinear.

A wrist edge 40 extends downwardly from upper free edge 32 to under-sleeve seam edge 26, and inclines inwardly from the line of the lateral free edge toward the midline such that the upper free edge distal portion 38 and the under-sleeve seam edge 26 are of equal length.

The right and left lower body portions provide a back leg seam edge 42 and front leg seam edges 43. In the particular embodiment shown in FIG. 1, blank 10 is designed to have two separately cut foot portions 44 (FIG. 5), of a generally known construction, attached to the body/leg portion of the blank. Alternatively, a garment according to the present invention can be constructed without a separately cut foot portion, the foot portion being cut integral with the major blank according to a pattern not shown herein but generally known in the art.

Figure 5:
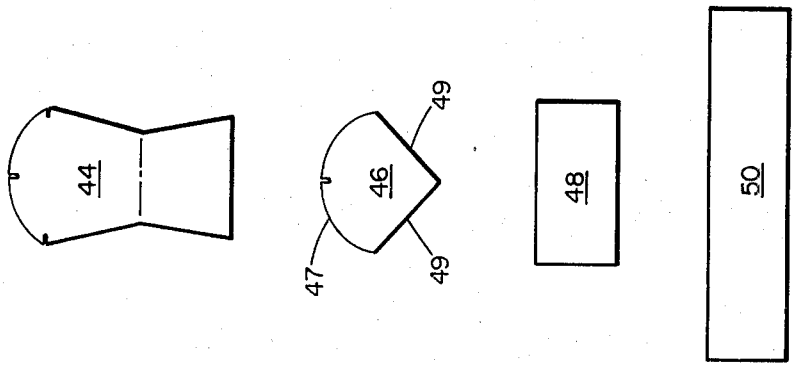
FIG. 5 shows subsidiary pieces that may be included in certain embodiments of the invention.

An optional crotch portion 46, cuff 48, and neck band 50 are also shown in FIG. 5, although a garment according to the present invention can be constructed without any of these additional pieces.

Blank 10, although generally symmetric about midline 12, provides asymmetric features designed to provide the front closure of the finished garment. The closure is designed to be a lapped pocket, in which one side of the placket overlies the other. In the finished garment corresponding to the particular embodiment shown in FIG. 1, the right side will overlie the left side. Right lateral free edge 18 extends further toward the foot of the garment than does left lateral free edge 19. The use of this design in constructing the finished garment will appear in what follows.

To assemble the garment, each shoulder/arm portion is folded downwardly toward the middle of the garment about a shoulder fold line indicated at 52, extending from neck opening 30 to wrist edge 40 and perpendicular thereto, and each lower body portion is folded toward midline 12 about a lateral fold line indicated at 54, generally parallel with midline 12 and extending from the inner end of cut 20 to the bottom of blank 10. Right upper free edge distal portion 38 is thereby opposed to right under-sleeve seam edge 26, and right upper free edge proximal portion 36 is opposed to right median seam edge 28. The corresponding edges of the left blank portion are similarly brought together with one another. The under-sleeve seams and median seams thus defined are joined by stitching or any other appropriate method. The resulting seams are colinear and generally perpendicular to longitudinal axis 12. The right under-sleeve seam is generally colinear and continuous with the right median seam, and similarly for the left side of the garment. The right and left median seams meet at the midline. The front and back leg seam edges are brought together to define an inner leg seam.

As a result of joining the median seams, placket upper edge 34 becomes colinear and continuous with lateral free edge 18 to form a placket edge. A placket margin of an appropriate width adjacent each placket edge is turned under and secured in place to form a finished edge. Crotch piece 46 is seamed to blank 10 with curved edge 47 seamed to back leg seam edge 42, and the finished edge of right blank part 14 is lapped over the finished edge of left blank part 16 before the leg seams are joined. The straight edges 49 of crotch piece 46 form continuations of back leg seam edge 42, which is seamed to front edges 43. In the finished garment, a portion of the right finished edge overlies an edge 49 of crotch piece 46, which is preferably reinforced, to provide a garment opening that extends partway down the right leg of the garment for ease of dressing or undressing the infant. Snap fasteners or other fastening means are applied to the placket in a known manner. A slide fastener could also be employed, in which case the placket finished edges would be abutted rather than lapped.

If it is desired to have the placket lap the other way (left over right), the blank of FIG. 1 is cut from a pattern that is reversed left to right from that shown.

Figure 4:
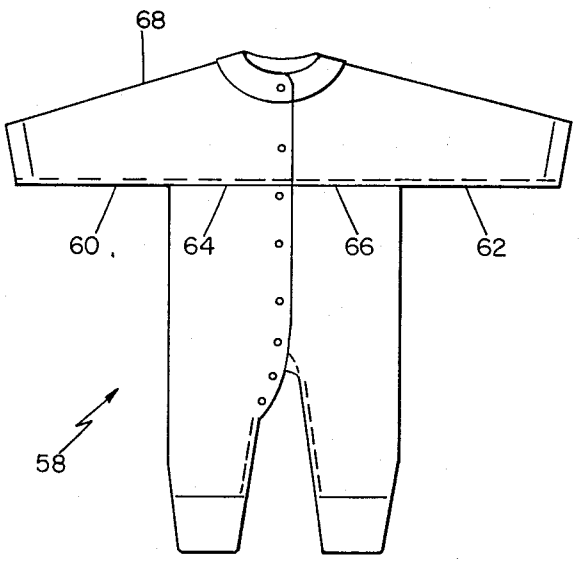
FIG. 4 shows a garment assembled from the blank of FIG. 1.

The finished garment 58 is seen in FIG. 4. The garment shown in this view has neither a neck band nor cuffs, but has a crotch piece and separately cut foot portions. As appears in the figure, the under sleeve seams 60 and 62 are continuous and colinear with the median seams 64 and 66, which meet at the front closure. The fold line 68 of the shoulder and sleeve is inclined upwardly from the wrist toward the mid line of the garment, rather than lying at right angles thereto, which provides good conformability and fit. The garment is integral and seamless through the back and over the shoulders, and is integral and seamless around the body between the placket edges. As is seen by comparing FIGS. 2, 3 and 4, the total seaming required to assemble the garment of the invention is less than is required in either of the prior art garments.

If the garment is to be assembled without a separately cut crotch piece 46, the excess length of right lateral free edge 18 is trimmed to correspond to left lateral free edge 19, and after the right and left finished placket edges have been formed by turning under the placket margins, the placket edges are lapped and are seamed together into the inner leg seam.

The construction of the garment of this embodiment of the invention is applicable to garments other than those providing integral foot/leg covering; a simple jacket or gown can also be made according to this design.

Figure 7:
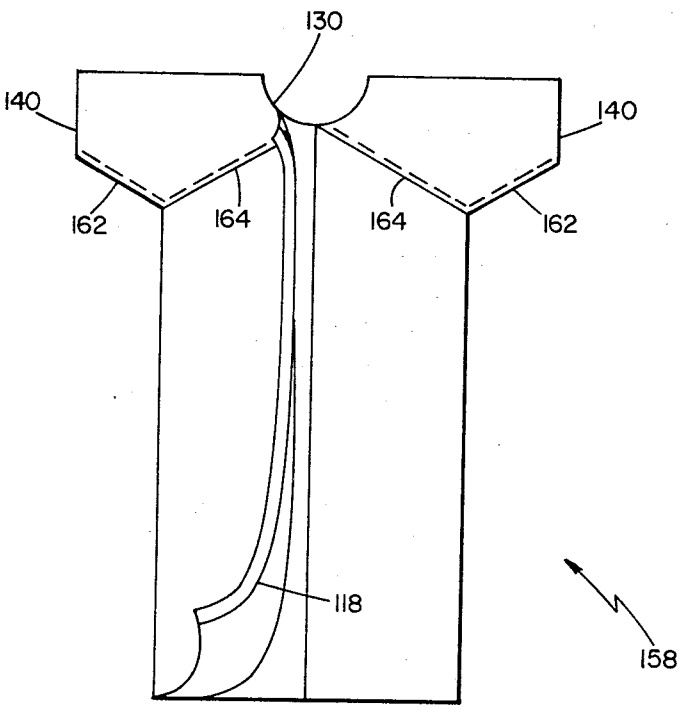
FIG. 7 shows a garment assembled from the blank of FIG. 6.
Figure 6:
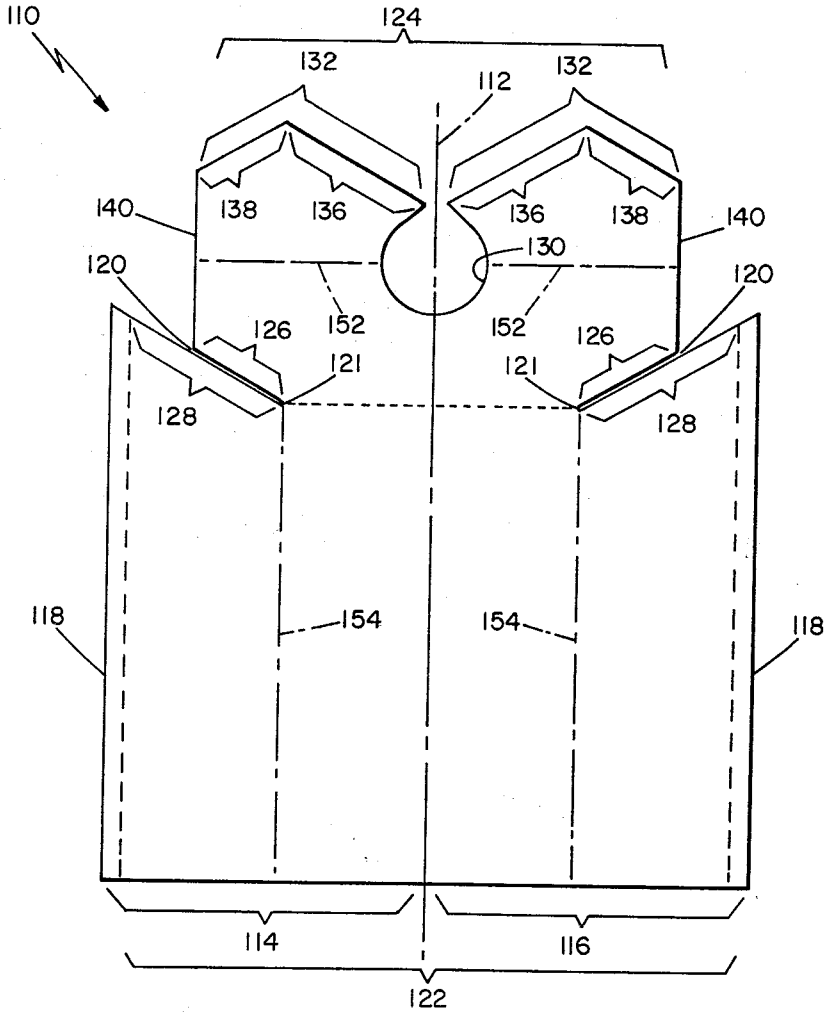
FIG. 6 shows a blank for an alternative embodiment of the invention.

An alternative embodiment is shown in FIGS. 6 and 7. A blank 110 is generally symmetric about a longitudinal midline 112 which defines right and left blank parts 114 and 116. Each blank part has a lateral free edge 118 generally parallel to midline 112, and a cut 120 extending inwardly from the lateral free edge to an interior point 121 approximately one-half the perpendicular distance from the lateral free edge to the midline. The right and left cuts 120 together with the line connecting the right and left interior points 121 divide blank 110 generally into a lower body portion 122 and a shoulder/arm portion 124.

Each cut 120 defines opposed edges 126 and 128. Edge 126, bordering shoulder/arm portion 124, is an under-sleeve seam edge; edge 128, bordering lower body portion 122, is a median seam edge.

The shoulder/arm portion 124 provides a garment neck opening 130 lying on midline 112. Each blank part has an upper free edge 132 lying between the line of lateral free edge 118 and midline 112. Each upper free edge 132 comprises a proximal portion 136 adjacent midline 112 and a distal portion 138 remote therefrom. Upper free edge distal portion 138 and the under-sleeve seam edge 126 of a blank part are opposable to define an under-sleeve seam, and upper free edge proximal portion 136 and the median seam edge 128 of a blank part are opposable to define a median seam.

The particular blank 110 of FIG. 6 is designed to form a gown rather than a garment with feet, but the modification to provide feet would be similar to the structure shown in FIGS. 1 and 5.

To assemble the garment, the shoulder/arm portion 124 is folded downwardly toward the middle of the garment about a shoulder fold line indicated at 152, extending from neck opening 130 to wrist edge 140 and perpendicular thereto, and the lower body portion 122 is folded toward middle 112 about lateral fold lines indicated at 154, each generally parallel with midline 112 and extending from an interior point 121 to the bottom of blank 110. Right upper free edge distal portion 138 is thereby opposed to right under-sleeve seam edge 126, and right upper free edge proximal portion 136 is opposed to right median seam edge 128. The corresponding edges of the left blank portion are similarly brought together with one another. The under-sleeve seams 162 and median seams 164 thus defined are joined by stitching or any other appropriate method. The resulting median seams 164 incline upwardly from the underarm to the neck opening, where they meet.

A placket margin of an appropriate width adjacent each lateral free edge 118 is turned under and secured in place to form a finished edge. Snap fasteners or other fastening means are applied to the placket in a known manner. The wrist edges 140 are finished in any suitable way.

The finished garment 158 is seen in FIG. 7. The garment is integral and seamless through the back and over the shoulders, and is integral and seamless around the body between the placket edges. In this embodiment, as in that of FIG. 4, the total seaming required to assemble the garment of the invention is less than is required in either of the prior art garments.

In accordance with the invention the angle of the median seam to the midline may vary between 0° (as in the garment of FIG. 4) and approximately 45° (as in the garment of FIG. 7), with appropriate changes in the finish of the placket edge.

What is claimed is:

1. A blank for at least a major portion of an infant's garment, said blank being generally symmetric about a longitudinal midline defining right and left blank parts, each said blank part having a lateral free edge generally parallel to said midline, and a single rectilinear cut extending inwardly from said lateral free edge toward said midline to an interior point approximately one-half the perpendicular distance from said lateral free edge to said midline, said right and left cuts together with the line connecting said right and left interior points dividing said blank generally into a lower body portion and a shoulder/arm portion, each said cut defining parallel closely spaced opposed edges comprising a median seam edge bordering said lower body portion and an under-sleeve seam edge bordering said shoulder/arm portion, said blank shoulder-arm portion providing a garment neck opening lying on said midline, each said blank part having an upper free edge lying between the line of said lateral free edge and said midline, each said upper free edge comprising a proximal portion adjacent said midline and a distal portion remote therefrom, the said upper free edge distal portion and said under-sleeve seam edge of a blank part being opposable to define an under-sleeve seam, and the said upper free edge proximal portion and said median seam edge of said blank part being opposable to define a median seam, said midline dividing said lower body portion into left and right lower body portions, each of said left and right lower body portions comprising two areas lying one on either side of a lateral fold line extending from said interior point to the bottom of said blank parallel with said midline, the area lying between said line and said lateral free edge being at least as great as the area lying between said line and said midline.

2. The blank of claim 1, each said blank part having a wrist edge extending downwardly from said upper free edge to said undersleeve seam edge and inclined inwardly from the line of said lateral free edge toward said midline such that said upper free edge distal portion and said under-sleeve seam edge are of equal length.

3. An infant's garment, said garment being generally symmetrical about a longitudinal midline defining right and left parts thereof, said garment providing a neck opening lying on said midline and placket margins defining a garment placket extending longitudinally from said neck opening, at least a major portion of said garment comprising a single integral fabric piece, said integral piece comprising a lower body portion and a shoulder/arm portion, said portions being integral through the back of said garment, said shoulder/arm portion being integral over each shoulder of said garment, said garment having right and left under-sleeve seams partially closing said shoulder-arm portion to form right and left sleeve tubes, said lower body portion being folded about two lateral fold lines each extending from a said under sleeve seam to the bottom of said garment generally parallel with said midline, each of said left and right lower body portions comprising two parts integral at said lateral fold line and lying one above the other, the upper said part having a margin continuous with said placket margin and having a fabric area at least as great as the under said part, said lower body portion being integral between said placket margins around said garment, said garment having right and left median seams each joining said shoulder/arm portion and said lower body portion from a said under-sleeve seam to the adjacent said placket margin.

4. The garment of claim 3, wherein said right median seam and said right under-sleeve seam are colinear and continuous, said left median seam and said left under-sleeve seam are colinear and continuous, and said left and right median seams meet at said garment midline.

5. The garment of claim 3, wherein said median seam extends from said under-sleeve seam edge to said garment neck opening.

6. A method of making an infant's garment, comprising the steps of cutting from a fabric sheet a blank for at least a major portion of said garment, said blank being generally symmetrical about a longitudinal midline defining right and left blank parts, each said blank part having a lateral free edge generally parallel to said midline, and a single rectilinear cut extending inwardly from said lateral free edge toward said midline to an interior point approximately one-half the perpendicular distance from said lateral free edge to said midline, said right and left cuts together with the line connecting said right and left interior points dividing said blank generally into a lower body portion and an upper shoulder/arm portion, said cut defining parallel closely spaced opposed edges comprising a median seam edge bordering said lower body portion and an under-sleeve seam edge bordering said shoulder/arm portion, said blank shoulder/arm portion providing a garment neck opening lying on said midline, each said blank part having an upper free edge extending from the line of said lateral free edge toward said midline, each said upper free edge comprising a proximal portion adjacent said midline and a distal portion remote therefrom, the said upper free edge distal portion and said under-sleeve seam edge of a blank part being opposable to define and under-sleeve seam, and the said upper free edge proximal portion and said median seam edge of said blank part being opposable to define a median seam, said midline dividing said lower body portion into left and right lower body portions, each of said left and right lower body portions comprising two areas lying one on either side of a lateral fold line extending from said interior point to the bottom of said blank parallel with said midline, the area lying between said line and said lateral free edge being at least as great as the area lying between said line and said midline, folding said shoulder/arm portion downwardly into a position in which each said upper free edge distal portion is opposed to a said under-sleeve seam edge;

folding said lower body portion about said lateral fold lines toward said midline into a position in which said upper free edge proximal portion is opposed to said median seam edge;

joining said upper free edge distal portion and said under-sleeve seam edge to form an under-sleeve seam; and joining said upper free edge proximal portion and said median seam edge to form a median seam.

7. A garment made according to the method of claim 6.

8. A blank for at least a major portion of an infant's garment, said blank being generally symmetrical about a longitudinal midline defining right and left blank parts, each said blank part having a lateral free edge generally parallel to said midline, and a cut extending inwardly from said lateral free edge toward said midline to an interior point approximately one-half the perpendicular distance from said lateral free edge to said midline, each said cut being inclined downwardly from the line of said lateral free edge toward said midline, said right and left cuts together with the line connecting said right and left interior points dividing said blank part into a lower body portion and a shoulder/arm portion, each said cut defining opposed edges comprising a median seam edge bordering said lower body portion and an under-sleeve seam edge bordering said shoulder/arm portion, said blank shoulder/arm portion providing a garment neck opening lying on said midline, each said blank part having an upper free edge extending from the line of said lateral free edge toward said midline, each said upper free edge comprising a proximal portion adjacent said midline, and a distal portion remote therefrom, said distal portion being inclined upwardly from the line of said lateral free edge toward said midline, said distal portion and said under-sleeve seam edge being of equal length, said proximal portion being inclined downwardly from said distal portion toward said midline and being parallel with the line of said cut, each said blank part having a wrist edge extending downwardly from said upper free edge to said under-sleeve seam edge each said blank part having major fold lines comprising a shoulder fold line extending from said neck opening to said wrist edge and perpendicular thereto, and a lateral fold line parallel to said midline and extending from the inner end of said cut to the bottom of said blank, each said shoulder/arm portion being foldable about said shoulder fold line to bring said upper free edge distal portion together with said under-sleeve seam edge to define an under-sleeve seam, the said upper free edge proximal portion and said median seam edge of a blank part being of equal length and opposable by said fold about said shoulder fold line to define a median seam.

9. A blank for at least a major portion of an infant's garment, said blank being generally symmetrical about a longitudinal midline defining right and left blank parts, each said blank part having a lateral free edge generally parallel to said midline, and a cut extending inwardly from said lateral free edge generally perpendicular to said midline for approximately one-half the width of said blank part measured from said lateral free edge to said midline, the line of said cut dividing said blank part into a lower body portion and a shoulder/arm portion, said cut defining opposed edges comprising a median seam edge bordering said lower body portion and an under-sleeve seam edge bordering said shoulder/arm portion, said right and left shoulder/arm portions together providing a garment neck opening lying on said midline, each said blank part shoulder/arm portion having a generally straight upper free edge inclined upwardly from the line of said lateral free edge toward said midline, and a placket edge extending between said upper free edge and said garment neck opening, said placket edge being generally perpendicular to said upper free edge, each said upper free edge comprising a proximal portion adjacent said placket edge, and a distal portion remote therefrom, the said upper free edge distal portion and said under-sleeve seam edge of a blank part being opposable to define an under-sleeve seam, and the said upper free edge proximal portion and said median seam edge of said blank part being opposable to define a median seam.

10. A method of making an infant's garment, comprising the steps of cutting from a fabric sheet a blank for at least a major portion of said garment, said blank being generally symmetrical about a longitudinal midline defining right and left blank parts, each said blank part having a lateral free edge generally parallel to said midline, and a cut extending inwardly from said lateral free edge generally perpendicular to said midline for approximately one-half the width of said blank part measured from said lateral free edge to said midline, the line of said cut dividing said blank part into a lower body/leg portion and an upper shoulder/arm portion, said cut defining opposed edges comprising a median seam edge bordering said body/leg portion and an under-sleeve seam edge bordering said shoulder/arm portion, said right and left shoulder/arm portions together providing a garment neck opening lying on said midline, each said blank part shoulder/arm portion having a generally straight upper free edge inclined upwardly from the line of said lateral free edge toward said midline, and a placket margin extending between said upper free edge and said garment neck opening, said placket margin being generally perpendicular to said upper free edge, each said upper free edge comprising a proximal portion adjacent said placket margin, and a distal portion remote therefrom, the said upper free edge distal portion and said under-sleeve seam edge of a blank part being opposable to define an under-sleeve seam, and the said upper free edge proximal portion and said median seam edge of said blank part being opposable to define a median seam;

folding each said shoulder arm portion downwardly into a position in which said upper free edge distal portion is opposed to said under-sleeve seam edge;

folding each said lower body portion toward said midline into a position in which said upper free edge proximal portion is opposed to said median seam edge;

joining said upper free edge distal portion and said under-sleeve seam edge to form an under-sleeve seam; and joining said upper free edge proximal portion and said median seam edge to form a median seam.

11. The method of claim 10 comprising the further step of on each blank part, turning under a portion of said shoulder/arm portion adjacent said placket edge and a portion of said lateral free edge and securing said turned portion in place to form a finished placket edge.

12. A garment made according to the method of claim 10.

13. A blank for at least a major portion of an infant's garment, said blank being generally symmetrical about a longitudinal midline defining right and left blank parts, each said blank part having a lateral free edge generally parallel to said midline, and a cut extending inwardly from said lateral free edge generally perpendicular to said midline for approximately one-half the width of said blank part measured from said lateral free edge to said midline, the line of said cut dividing said blank part into a lower body portion and a shoulder/arm portion, said cut defining opposed edges comprising a median seam edge bordering said lower body portion and an under-sleeve seam edge bordering said shoulder/arm portion, said right and left shoulder/arm portions together providing a garment neck opening lying on said midline, each said blank part shoulder/arm portion having a generally straight upper free edge inclined upwardly from the line of said lateral free edge toward said midline, and a placket margin extending between said upper free edge and said garment neck opening, said placket margin being generally perpendicular to said upper free edge, each said upper free edge comprising a proximal portion adjacent said placket margin, and a distal portion remote therefrom, each said blank part having a wrist edge extending downwardly from said upper free edge to said under-sleeve seam edge and inclined inwardly from the line of said lateral free edge toward said midline such that said upper free edge distal portion and said undersleeve seam edge are of equal length, each said blank part having major fold lines comprising a shoulder fold line extending from said neck opening to said wrist edge and perpendicular thereto, and a lateral fold line parallel to said midline and extending from the inner end of said cut to the bottom of said blank, each said lower body portion providing front and back leg portion edges, said inner body portion being foldable about said lateral fold line to bring together said front and back leg portion edges to define an inner leg seam, each said shoulder/arm portion being foldable about said shoulder fold line to bring said upper free edge distal portion together with said under-sleeve seam edge to define an under-sleeve seam, the said upper free edge proximal portion and said median seam edge of a blank part being of equal length and opposable to define a median seam.

14. A method of making an infant's garment, comprising the steps of cutting from a fabric sheet a blank for at least a major portion of said garment, said blank being generally symmetrical about a longitudinal midline defining right and left blank parts, each said blank part having a lateral free edge generally parallel to said midline, and a cut extending inwardly from said lateral free edge toward said midline to an interior point approximately one-half the perpendicular distance from said lateral free edge to said midline, each said cut being inclined downwardly from the line of said lateral free edge toward said midline, said right and left cuts together with the line connecting said right and left interior points dividing said blank part into a lower body portion and a shoulder/arm portion, each said cut defining opposed edges comprising a median seam edge bordering said lower body portion and an under-sleeve seam edge bordering said shoulder/arm portion, said blank shoulder/arm portion providing a garment neck opening lying on said midline, each said blank part having an upper free edge extending from the line of said lateral free edge toward said midline, each said upper free edge comprising a proximal portion adjacent said midline and a distal portion remote therefrom, said distal portion being inclined upwardly from the line of said lateral free edge toward said midline, said distal portion and said under-sleeve seam edge being of equal length, said proximal portion being inclined downwardly from said distal portion toward said midline and being parallel with the line of said cut, the said upper free edge distal portion and said under-sleeve seam edge of a blank part being opposable to define an under-sleeve seam, and the said upper free edge proximal portion and said median seam edge of said blank part being opposable to define a median seam;

folding each said shoulder/arm portion downwardly into a position in which said upper free edge distal portion is opposed to said under-sleeve seam edge;

folding each said lower body portion toward said midline into a position in which said upper free edge proximal portion is opposed to said median seam edge;

joining said upper free edge distal portion and said under-sleeve seam edge to form an under-sleeve seam; and joining said upper free edge proximal portion and said median seam edge to form a median seam.

15. A garment made according to the method of claim 14.

* * * * *